US005277832A

United States Patent [19]

Gill et al.

[11] Patent Number: 5,277,832

[45] Date of Patent: Jan. 11, 1994

[54] RECOVERY OF REACTIVE SOAP LUBRICANTS

[75] Inventors: Colman A. Gill, Bloomfield Hills; Catherine M. Berbiglia, Farmington Hills, both of Mich.

[73] Assignee: Freiborne Industries, Inc., Troy, Mich.

[21] Appl. No.: 758,589

[22] Filed: Sep. 12, 1991

[51] Int. Cl.[5] ..... C10M 101/00; B01D 9/00

[52] U.S. Cl. ..... 252/38; 252/495; 252/370; 427/327; 554/75; 554/156; 554/195

[58] Field of Search ..... 427/327; 554/75, 156, 554/195; 252/38, 49.3, 370

[56] References Cited

U.S. PATENT DOCUMENTS

| | | | |
|---|---|---|---|
| 2,216,238 | 10/1940 | Harder | 554/195 |
| 2,628,202 | 2/1953 | Allison et al. | 554/75 |
| 2,650,932 | 9/1953 | Kebrich et al. | 554/156 |
| 2,890,232 | 6/1959 | Rogens et al. | 554/156 |
| 2,945,051 | 7/1960 | Davis | 554/75 |
| 2,993,921 | 7/1961 | Meyer | 554/75 |
| 3,803,188 | 4/1974 | Scott et al. | 554/75 |
| 4,235,794 | 11/1980 | Rieber et al. | 554/75 |
| 4,307,027 | 12/1981 | Borzelli et al. | 554/75 |
| 4,316,052 | 2/1982 | Blachford | 554/75 |
| 4,810,398 | 3/1989 | Van Kruchten et al. | 252/38 |

*Primary Examiner*—Prince Willis, Jr.
*Assistant Examiner*—James M. Silbermann
*Attorney, Agent, or Firm*—Dykema Gossett

[57] ABSTRACT

Methods for treating spent reactive soap lubricant baths employed in a cold forming process for metal treatment are described. One method involves treatment of the spent solution with acid to form stearic acid, collection of the stearic acid, and reaction of the stearic acid with a metal salt to form metal stearates. This method is preferably used to prepare sodium stearate. An alternative method involves treatment of a basic (i.e., pH greater than 7 or preferably greater than 10) spent reactive soap lubricant bath with certain metallic stearates, including aluminum stearate, zinc stearate, aluminum stearate, zinc stearate, barium stearate, lithium stearate, and calcium stearate. The metal stearates can be used in conventional lubricant formulations used in the metal forming or metal working industry. Sodium stearate recovered by the present invention is of sufficient purity that it can be reused in reactive soap lubricant baths. In one preferred embodiment, the process of this invention is incorporated into a cold forming operation, thereby providing for an essentially closed process relative to the sodium stearate component.

19 Claims, 2 Drawing Sheets

RECOVERY OF REACTIVE SOAP LUBRICANTS

FIELD OF THE INVENTION

This invention generally relates to metal stearate lubricants used in metal forming and metal working operations. More specifically, this invention relates to the recovery of spent reactive sodium stearate solutions from cold forming operations whereby the stearic acid component is recovered and then converted into metallic stearate soaps which are useful as lubricants in the metal forming and metal working industry. Recovered sodium stearate soaps can also be used in preparing new reactive sodium stearate baths or systems.

BACKGROUND OF THE INVENTION

Reactive sodium stearate lubricant systems are used extensively in the metal forming and metal working industry, especially in cold forming operations. Such reactive sodium stearate lubricant systems consist of high-purity sodium stearate in an aqueous solution and are often referred to simply as "reactive soaps." Such reactive soaps have been used in metal treating operations for at least the last forty years.

The reactive soaps for cold forming operations are prepared from high purity stearic acid which contains about 95 percent by weight, at a minimum, of the C-18 fatty acid and only low levels of heavy metals (i.e., generally less than about 0.01 percent by weight). Lower grades of stearic acid (often referred to as "rubber grade" stearic acid) contain less than about 70 to 80 weight percent of the C-18 chain length fatty acid. Such lower grades of stearic acid cannot be used to prepare reactive soaps. The high-purity grades of stearic acid necessary for reactive soaps are, of course, considerable more expensive than the "rubber grades." For example, stearic acid suitable for use in preparing reactive soaps currently cost about $0.55 per pound as compared to about $0.29 per pound for "rubber grade" material. Generally, a reactive soap bath contains about one pound of sodium stearate per gallon of bath. Based on the extensive use of such baths in cold forming of steel and aluminum, the cost of high purity sodium stearate represents a significant cost element in cold forming operations.

The metal work piece in cold forming operations is first phosphated in a zinc phosphate conversion bath whereby a zinc phosphate layer or coating is formed on the substrate or work piece. The phosphated work piece is then immersed in a high-purity sodium stearate or reactive soap solution (usually buffered at a pH of about 8 to 10). A reaction occurs between the sodium stearate and the zinc phosphate coating whereby a portion of the zinc phosphate coating is converted to zinc stearate via the following reaction:

$$Zn(PO_4)_2+6Na(OOC(CH_2)_nCH_3)\rightarrow 3Zn(OOC(CH_2)_nCH_3)_2+2Na_3PO_4,$$

where n is 16. The lubricant system formed on the metal substrate consists essentially of three layers (in order): (1) a layer of zinc phosphate adjacent to the substrate surface; (2) a layer of zinc stearate formed by the above reaction on top of the zinc phosphate layer; and (3) a final or top layer of sodium stearate. In this system, the zinc phosphate is chemically bonded to the substrate surface and the zinc stearate is chemically bonded to the zinc phosphate layer.

One of the major drawbacks to the reactive lubricant system is its sensitivity to contamination by metals entering the bath during normal operation. The degree of conversion of the zinc phosphate to zinc stearate generally decreases with the age of the reactive soap bath. The decreased efficiency of a reactive soap bath is generally due to an increase in contaminants which interfere with or inhibit the reaction between the zinc phosphate and the sodium stearate. Such contaminants include heavy metals (e.g., zinc and iron) which may be introduced through "drag-in" from earlier stages of the treatment process and from reactions with the substrate, as well as calcium and magnesium salts from the aqueous media. Such metal contaminants form their corresponding stearates in the bath. Generally, when the combined metal contaminant levels in the reactive soap exceed about 0.1 percent by weight, the lubricant system is no longer satisfactory for most cold forming operations and is considered "spent."

The most common method of treating a spent reactive sodium stearate bath is to simply discard the bath and prepare a new bath using fresh, high-purity sodium stearate. Normally, the spent reactive soaps are hauled away by a waste disposal company for treatment and disposal. Such a system is economically and environmentally unsound. As environmental regulations on the disposal of such wastes increase, these costs are expected to increase. Most conventional methods for removing the metal contaminants from spent reactive soap solutions cannot be used. For example, any filtering media or system would be quickly clogged with fatty acids or soaps if such filtering methods were attempted. To date the only alternative to direct disposal of the spent reactive soaps is the mechanical removal of the metal contaminants by periodic or continuous centrifuging operations. Such centrifugation methods are messy, difficult, and costly and have not, therefore, been widely accepted. Although the metal working and metal forming industry has been aware of these problems and has been forced to deal with these problems on a daily basis for almost forty years, no generally satisfactory solution has been found.

It is desirable, therefore, to provide a method by which spent reactive soap lubricants can be easily treated. It is also desirable to provide a method by which high purity stearic acid can be recovered from spent reactive sodium stearate lubricant baths. It is also desirable to provide a method by which the useful lifetime of reactive sodium stearate solutions can be extended. The present invention achieves these and other objectives as fully described in this specification using a straight-forward and simple treatment process.

SUMMARY OF THE INVENTION

This invention relates to a method or process by which spent reactive soap lubricants prepared from high purity stearic acid and used in cold forming operations can be treated to recover the high purity stearic acid. The recovered high-purity stearic acid is then converted into metallic stearates which are useful as lubricants in the metal forming and metal working industry. The recovered stearic acid is preferably converted into sodium stearate which can be used to prepare additional reactive soap solution for use in cold forming operations.

This invention also relates to a method of operating a reactive sodium stearate bath whereby the reactive sodium stearate solution is removed on a semi-continuous or continuous basis. The solution is then treated to remove metal contaminants and recover the sodium stearate. The recovered sodium stearate is then returned to the bath. Using this process, the life of the bath can be significantly extended.

This invention also relates to a process by which certain metallic stearates—i.e., hydrophobic metallic stearates including aluminum stearate, zinc stearate, barium stearate, lithium stearate, and calcium stearate—can be more directly recovered from a spent reactive sodium stearate solution from cold forming operations. This simplified method involves rendering, if necessary, the pH of the spent reactive sodium stearate solution basic and then reacting it directly with the appropriate metallic salt. The metallic stearate forms on the surface of the spent solution where it can be collected.

One object of the present invention is to provide a process for the recovery of a metallic stearate lubricant from spent reactive sodium stearate solution from cold forming operations, said process comprising:

(1) acidifying the spent reactive sodium stearate solution;
(2) cooling the acidified solution so that the fatty acid forms on the surface of the acidified solution;
(3) collecting the fatty acid formed on the surface of the cooled and acidified solution;
(4) heating the collected fatty acid to a temperature sufficient to liquefy the collected fatty acid;
(5) reacting the liquefied fatty acid with a metal salt to produce a metallic stearate lubricant; and
(6) collecting the metallic stearate lubricant.

Another object of the present invention is to provide a method for operating a reactive lubricant bath in a cold forming treatment process where the reactive lubricant bath is a buffered, aqueous solution containing sodium stearate prepared from high purity stearic acid, said method comprising:

(1) periodically removing a portion of the aqueous solution;
(2) acidifying the removed aqueous solution at a temperature of 180° F. or higher;
(3) cooling the acidified solution so that the fatty acid forms on the surface of the acidified solution;
(4) collecting the fatty acid formed on the surface of the cooled and acidified solution;
(5) heating the collected fatty acid to a temperature sufficient to liquefy the collected fatty acid;
(6) reacting the liquefied fatty acid with a sodium salt to produce sodium stearate;
(7) returning the recovered sodium stearate to the reactive lubricant bath.

Still another object of the present invention is to provide a process for the recovery of a hydrophobic metallic stearate from a spent reactive sodium stearate solution from cold forming operations, said process comprising:

(1) adjusting the pH of the spent reactive sodium stearate solution to a value greater than about 7;
(2) reacting the basic spent reactive sodium stearate solution with a metal salt where the metal of the metal salt is selected from the group consisting of aluminum, zinc, barium, lithium, and calcium; and
(3) collecting the hydrophobic metallic stearate from the surface of the solution formed in step (2).

These and other objects will be apparent from a consideration of this specification, including the drawings and claims.

These figures are intended to illustrate the invention and not to limit it.

DESCRIPTION OF THE PREFERRED EMBODIMENTS

This invention relates to reactive soap lubricants and reactive soap lubricant baths used in cold forming operations. More specifically, this invention relates to a process for treating spent reactive sodium stearate solutions whereby a high-purity, metallic stearate can be recovered. Such metallic stearates are useful in lubricant formulations designed for use in metal forming or metal working applications. This method is especially preferred for treating spent reactive sodium stearate solutions whereby high-purity sodium stearate can be recovered. This recovered sodium stearate can be used in reactive soap lubricant baths as well as in other lubricant formulations. The method of this invention can also be adapted to be incorporated into a cold forming operation wherein the lifetime of the reactive soap lubricant bath can be significantly extended.

The process of the present invention essentially involves acidifying the spent reactive sodium stearate bath solution in order to form stearic acid. The stearic acid is then collected or separated from the aqueous phase and treated with a metal salt to obtained the desired metal stearate. The reactive sodium stearate baths suitable for treatment by this invention are generally those used for treatment of phosphated substrates, especially in cold forming operations. Such baths are normally treated by the process of the present invention when the zinc phosphate coatings on phosphated substrates immersed in the bath are no longer converted to zinc stearate in sufficient amounts to provide the desired lubricating characteristics. Generally, a reactive sodium stearate bath is considered spent or used up when the combined levels of metal contaminants reaches a level of about 0.1 weight percent. If desired, however, the process of this invention can be used to treat reactive sodium stearate bath solutions which contain less than 0.1 weight percent of combined metal contaminants.

Figure 1:
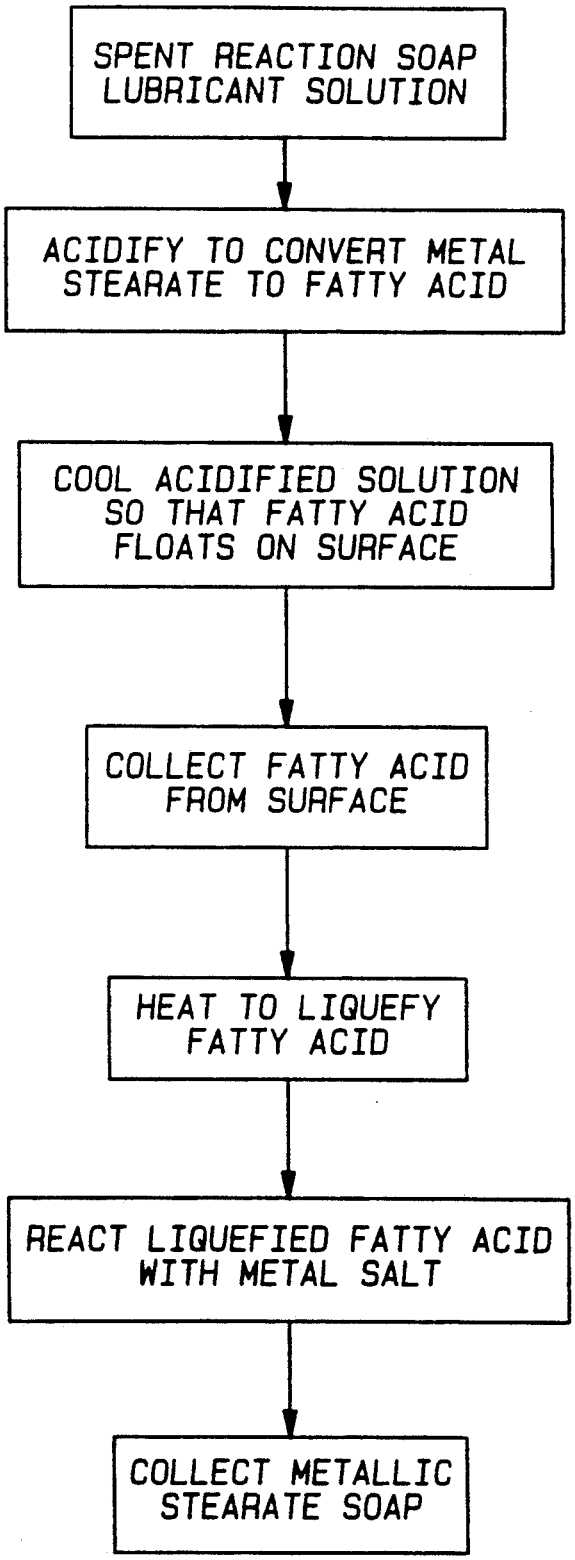
FIG. 1 is a flow chart illustrating the general method of this invention.

FIG. 1 shows the general procedure of the present invention. Spent reactive soap lubricant solution is first collected by any conventional means. For example, the spent solution from the bath can be pumped or poured into a separate vessel for treatment. Or the spent solution can be treated in the same vessel as used for immersing the phosphated work piece. The spent solution is treated with an acid so that the sodium stearate is converted to stearic acid. Suitable acids include sulfuric acid, hydrochloric acid, phosphoric acid, nitric acid, acetic acid, or perchloric acid. Generally, sulfuric acid and phosphoric acid are the preferred acids. The actual pH of the acidified solution is not critical so long as the pH is sufficiently below 7 so that the metallic stearates are converted to stearic acid. Generally, however, adjusting the pH to about 4 to 6 will achieve satisfactory results.

It is generally preferred that the spent solution is hot when acidified. The bath temperature is preferably above about 180° F. and most preferably in the range of about 180° to 210° F. during the acidification treatment. Elevated temperatures allow for faster reaction times and generally cleaner separations between the fatty acid and the contaminants which remain in solution.

Upon cooling the acidified solution, the insoluble stearic acid formed will collect or float on the surface of the aqueous layer. This stearic acid is then separated from the aqueous media. Normally, the stearic acid can simply be skimmed off the surface. Other techniques can also be used to accomplish this separation. It is generally preferred that as little water accompany the stearic acid as possible. The remaining aqueous phase should contain a significant amount of the metal contaminants present in the spent reactive soap solution. This aqueous phase can be treated prior to disposal or can treated and recycled in other processes where any remaining contaminants will not be detrimental.

Again as illustrated in FIG. 1, the collected fatty acid (stearic acid) is then heated to a temperature sufficient to melt or liquefy the stearic acid. Stearic acid has a melting point of about 160° F. Once liquefied, the fatty acid is reacted with a metal salt to form the desired metal stearate. Suitable metals include calcium, sodium, potassium, barium, zinc, or aluminum. Suitable salts include metal hydroxides, metal carbonates, and the like. Generally, the preferred metal salts contain sodium. Once the metal stearates are formed, they are collected using conventional techniques.

The metal stearates formed will generally be of the same, or at least very close to, purity levels of the stearic acid and sodium stearate used to originally prepare the reactive soap bath. Generally, the recovered metal stearate of this invention will have greater than about 95 to 97 weight percent of the C-18 fatty acid group. When dissolved in water at a level normally used in cold forming operations, the combined heavy metal contaminant level is expected to be significantly below 0.1 weight percent. When the metal is sodium, the recovered sodium stearate can be used in reactive soap baths. The metal stearates can also be used in lubricant formulations where "rubber grade" metal stearate soaps are normally employed. Such metal stearate soaps prepared with the metallic stearates of this invention should perform as well as, and in many cases much better than, the formulations prepared with "rubber grade" material due to the significantly increased purity and chain length (i.e., percentage of C-18 chains) levels.

In addition to providing metal stearates suitable for use in lubricant formulations designed for the metal working and metal forming industry, and perhaps more significantly, the process of the present invention provides an alternative treatment process for spent reactive soap lubricant baths. As noted above, these spent baths have either been discarded as a waste material or treated by a messy, difficult, and costly centrifugation process. The process of the present invention solves a difficult and costly treatment problem in a simple and inexpensive manner while minimizing environmental problems. The process of the present invention is easily adapted to current cold forming operations and can be incorporated into such a process with minimal effort. This process can be run in a batch, semi-continuous, or continuous manner as desired.

Figure 2:
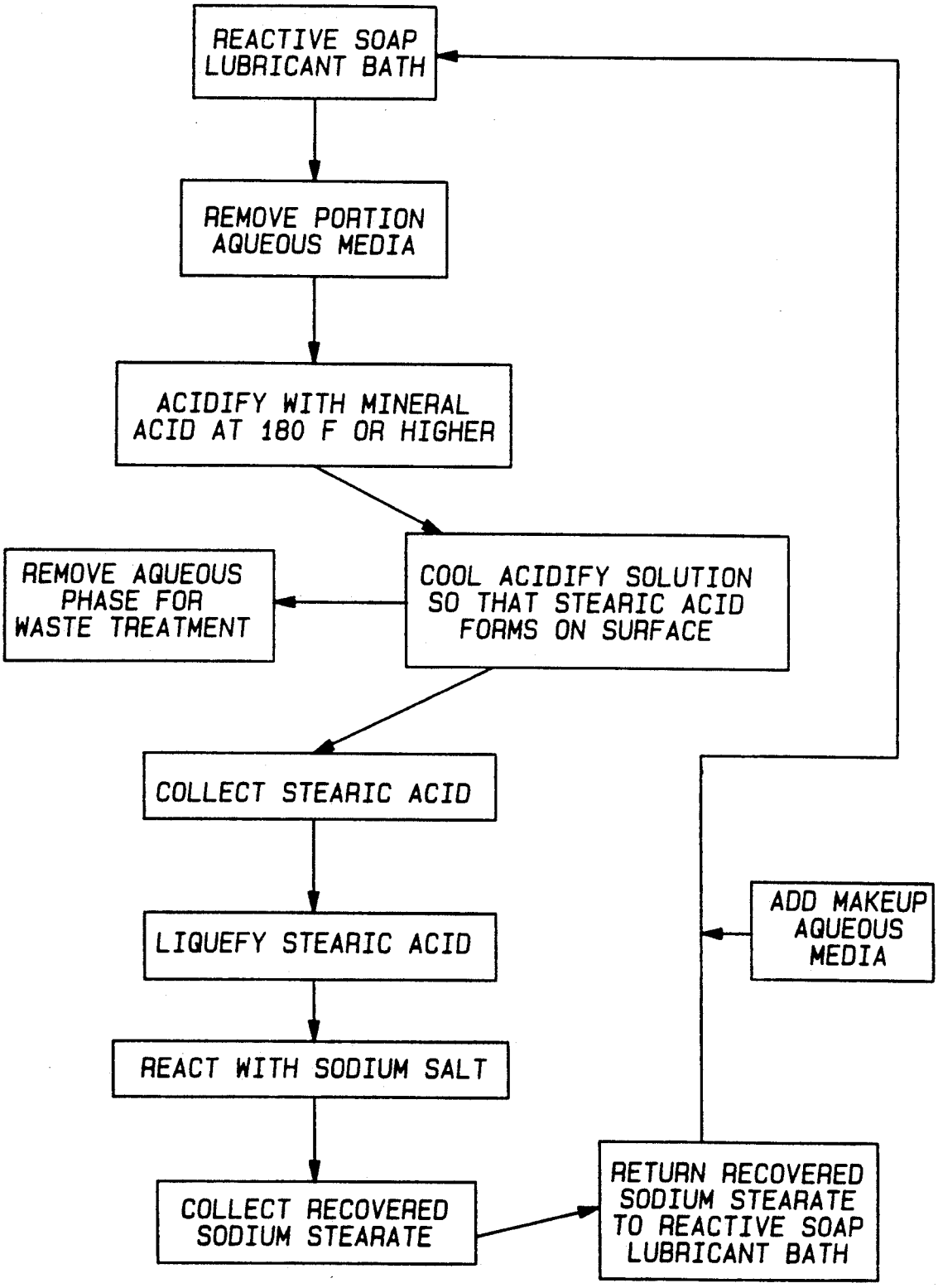
FIG. 2 is a flow chart illustrating a preferred method of this invention which can be incorporated into a continuous or semi-continuous process of cold forming. The metal work pieces to be treated in the reactive soap lubricant bath and the remainder of the cold forming operation are not shown.

A preferred embodiment of the present invention is shown in FIG. 2. Such a process could be incorporated into a cold forming operation for treating steel or aluminum substrates. (The other components of such a cold forming operation are not shown in FIG. 2.) In FIG. 2, a portion of the solution contained in the reactive soap lubricant bath is removed periodically for treatment. It is not necessary that the material removed for treatment is "spent." Rather, it is preferred that material from the bath is treated prior to the bath reaching a "spent" state or condition. The net amount of material remaining in the bath should be sufficient for continuing operation of the cold forming process. In addition to the material removed for treatment, material can be added on a periodic basis so that bath can be used on an essentially continuous basis; such added material can be in the form of recovered sodium stearate or makeup water with or without new, high-purity sodium stearate.

The removed material is then acidified with a mineral acid selected from the group consisting of sulfuric acid, hydrochloric acid, phosphoric acid, nitric acid, acetic acid, and perchloric acid at a temperature of at least 180° F. Preferably, the acidification temperature is in the range of 180° to 210° F. The acidified solution is then cooled so that the stearic acid forms or floats on the surface of the aqueous media. The aqueous media and the solid stearic acid are separated using conventional techniques. The aqueous layer can be treated in a wastewater treatment facility and then discharged or recycled. The collected stearic acid component is then heated to above its melting point and then reacted with a sodium salt. Generally, sodium hydroxide and sodium carbonate are the preferred sodium salts. The sodium stearate is collected and then returned to the reactive soap lubricant bath. Generally, it is preferred that the sodium stearate is returned in the form of an aqueous, buffered solution of essentially the same composition as the original bath. As illustrated in FIG. 2, makeup water, which can contain, if desired, other components utilized in the bath, can be added to the bath. This makeup water can be used to dissolved the recovered sodium stearate prior to its addition or it can be added separately.

FIG. 2 represents an essentially closed system with respect to the sodium stearate component. Such a system should significantly extend the life of the reactive soap bath in a cold forming process. Additional purification steps can be added to the process illustrated in FIG. 2 to extend the bath lifetime even further. For example, the collected stearic acid and/or the recovered sodium stearate could be further purified before the recovered sodium stearate is recycled back to the bath. At some point, however, it is likely that contamination build up will be so significant that the bath will no longer be suitable for use in a cold forming operation even if treated by the process of this invention. In such cases, it will be necessary to treat the entire contents of the bath. The bath may still, however, be treated by the process of this invention as generally illustrated in FIG. 1. The metal stearates prepared by such a process should be suitable for use in lubricant formulations normally employing "rubber grade" soaps.

The process described above can be used to prepare a wide variety of metallic stearates. Certain metallic stearates can also be prepared, if desired, by another similar process. This alternative process can be used to prepare hydrophobic metallic stearates, including aluminum stearate, zinc stearate, barium stearate, lithium stearate, and calcium stearate. Sodium stearate or potassium stearate cannot be prepared by this alternative method because they are not hydrophobic and are readily soluble in basic aqueous solutions.

These hydrophobic metallic stearates can be prepared from spent reactive sodium stearate solutions from cold forming operations by first assuring that the pH of the spent solution is basic (i.e., a pH of greater than 7 and, preferably, greater than 10). In some cases the spent solution may have the desired pH without further addition of pH-raising substances. In some cases, however, it will be necessary to further adjust the pH to the desired range by adding a pH-raising substance such as sodium hydroxide, sodium carbonate, potassium hydroxide, or potassium carbonate. Even if the pH of the spent solution as received is between 7 and about 8, it is generally preferred that such a pH-raising substance is added to bring the pH above about 10.

Once the pH is adjusted to the appropriate level, the basic spent reactive sodium stearate solution is reacted with a metal salt where the metal in the metal salt is selected from the group consisting of aluminum, zinc, barium, lithium, and calcium. The preferred cations in this metal salt are aluminum and zinc with aluminum being most preferred. The anion in the metal salt is not critical so long as the metal salt is soluble in water and the resulting compound or complexes containing the anion are also soluble in water. Suitable anions include, for example, the chlorides, bromides, sulphates, nitrates, and the like.

The metal salt reacts with the sodium stearate to form the corresponding insoluble and hydrophobic metallic stearates. Although not wishing to be limited by theory, it is thought that the following reactions, using an aluminum salt as an example, may occur:

$$\text{Na(stearate)} + 2\text{NaOH} + \text{Al}^{+++} \rightarrow \text{Al(OH)}_2\text{(stearate)} \downarrow + 3\text{Na}^+$$

$$2\text{Na(stearate)} + \text{NaOH} + \text{Al}^{+++} \rightarrow \text{Al(OH)(stearate)}_2 \downarrow + 3\text{Na}^+$$

$$3\text{Na(stearate)} + \text{Al}^{+++} \rightarrow \text{Al(stearate)}_3 \downarrow + 3\text{Na}^+$$

The various aluminum stearates in the above equations are insoluble in water and are hydrophobic. The various aluminum stearates will, therefore, precipitate out of the aqueous solution. These various aluminum stearates have specific gravities less than 1 and will, therefore, float on the surface of the aqueous solution. The stearates can be removed by conventional techniques and treated as in the earlier described processes. Impurities (i.e., heavy metals) will remain in the aqueous solution and will, therefore, be removed from the recovered metallic stearates. The metallic stearates obtained in this alternate process can be used in the same manner as the metallic stearates prepared by the processes of this invention described in FIG. 1 and 2 (allowing for the fact that sodium or potassium stearate cannot be prepared by this alternative process).

As noted above, this alternate process cannot be used to recover sodium stearate or potassium stearate. The preferred general process of this invention remains the recovery of sodium stearate using the process describe in FIG. 1 and, more preferably, the process described in FIG. 2.

That which is claimed:

1. A process for the recovery of a metallic stearate lubricant from spent reactive sodium stearate solution from cold forming operations, said process comprising:

(1) acidifying the spent reactive sodium stearate solution;
(2) cooling the acidified solution so that the fatty acid forms on the surface of the acidified solution;
(3) collecting the fatty acid formed on the surface of the cooled and acidified solution;
(4) heating the collected fatty acid to a temperature sufficient to liquefy the collected fatty acid;
(5) reacting the liquefied fatty acid with a metal salt to produce a metallic stearate lubricant; and
(6) collecting the metallic stearate lubricant.

2. A process as defined in claim 1, wherein the spent reactive sodium stearate solution in step (1) is at temperature of 180° F. or higher and is acidified with sulfuric acid, hydrochloric acid, phosphoric acid, nitric acid, acetic acid, or perchloric acid.

3. A process as defined in claim 2, wherein the metal of the metal salt is calcium, sodium, potassium, barium, zinc, or aluminum.

4. A process as defined in claim 3, wherein the metal salt is sodium hydroxide or sodium carbonate.

5. A process as defined in claim 3, wherein the metal salt is calcium hydroxide or calcium carbonate.

6. A process as defined in claim 3, wherein the metal salt is potassium hydroxide or potassium carbonate.

7. A process as defined in claim 3, wherein the metal salt is barium hydroxide or barium carbonate.

8. A process as defined in claim 3, wherein the metal salt is zinc hydroxide or zinc carbonate.

9. A process as defined in claim 3, wherein the metal salt is aluminum hydroxide or aluminum carbonate.

10. A process as defined in claim 1, wherein the spent reactive sodium stearate solution in step (1) is at a temperature of 180° to 210° F. and is acidified with sulfuric acid, hydrochloric acid, phosphoric acid, nitric acid, acetic acid, or perchloric acid and wherein the metal salt in step (5) is sodium hydroxide or sodium carbonate.

11. A process as defined in claim 10, wherein the metallic stearate lubricant collected in step (6) is a sodium stearate lubricant which contains less than about 0.01 percent by weight of zinc, calcium, magnesium, aluminum, and iron contaminants.

12. A method for operating a reactive lubricant bath in a cold forming treatment process where the reactive lubricant bath is a buffered, aqueous solution containing sodium stearate prepared from high purity stearic acid, said method comprising:

(1) periodically removing a portion of the aqueous solution;
(2) acidifying the removed aqueous solution at a temperature of 180° F. or higher;
(3) cooling the acidified solution so that the fatty acid forms on the surface of the acidified solution;
(4) collecting the fatty acid formed on the surface of the cooled and acidified solution;
(5) heating the collected fatty acid to a temperature sufficient to liquefy the collected fatty acid;
(6) reacting the liquefied fatty acid with a sodium salt to produce sodium stearate;
(7) returning the recovered sodium stearate to the reactive lubricant bath.

13. A method as defined in claim 12, wherein the sodium salt is sodium hydroxide or sodium carbonate.

14. A method as defined in claim 13, wherein the recovered sodium stearate is returned to the reactive lubricant bath in the form of a buffered, aqueous solution.

15. A process for the recovery of a hydrophobic metallic stearate from a spent reactive sodium stearate solution from cold forming operations, said process comprising:

(1) adjusting the pH of the spent reactive sodium stearate solution to a value greater than about 7;

(2) reacting the basic spent reactive sodium stearate solution with a metal salt where the metal of the metal salt is selected from the group consisting of aluminum, zinc, barium, lithium, and calcium; and (3) collecting the hydrophobic metallic stearate from the surface of the solution formed in step (2).

16. A process as defined in claim 15, wherein the recovered hydrophobic metallic stearate is further dried and ground.

17. A process as defined in claim 14, wherein the hydrophobic metallic stearate is aluminum stearate.

18. A process as defined in claim 15, wherein the pH in step (1) is adjusted to a value greater than about 7 by the addition of sodium hydroxide, sodium carbonate, potassium hydroxide, or potassium carbonate.

19. A process as defined in claim 18, wherein the hydrophobic metallic stearate is aluminum stearate.

* * * * *